US011408577B2

(12) United States Patent
Zhang

(10) Patent No.: US 11,408,577 B2
(45) Date of Patent: Aug. 9, 2022

(54) TRANSPARENT PHOTOCONDUCTOR HAVING LIGHT SHIELDING FUNCTION, AND APPLICATION THEREOF

(71) Applicant: HASCO VISION TECHNOLOGY CO., LTD., Shanghai (CN)

(72) Inventor: Jie Zhang, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 550 days.

(21) Appl. No.: 16/476,315

(22) PCT Filed: May 8, 2017

(86) PCT No.: PCT/CN2017/083411
§ 371 (c)(1),
(2) Date: Jul. 8, 2019

(87) PCT Pub. No.: WO2018/129841
PCT Pub. Date: Jul. 19, 2018

(65) Prior Publication Data

US 2021/0404624 A1 Dec. 30, 2021

(30) Foreign Application Priority Data

Jan. 12, 2017 (CN) ..... 201710022825.7
Feb. 12, 2017 (CN) ..... 201720035887.7

(51) Int. Cl.
*F21V 5/04* (2006.01)
*F21S 41/43* (2018.01)
(Continued)

(52) U.S. Cl.
CPC ..... *F21S 41/43* (2018.01); *F21S 41/255* (2018.01); *F21S 41/365* (2018.01); *F21W 2102/135* (2018.01)

(58) Field of Classification Search
CPC ..... F21S 41/43; F21S 41/255; F21S 41/365; F21S 41/285; F21S 41/24; F21S 41/27;
(Continued)

(56) References Cited

U.S. PATENT DOCUMENTS 10,018,316 B2 * 7/2018 Chen ..... F21S 41/321
2016/0040848 A1 * 2/2016 Tsukamoto ..... F21S 41/321 362/509

FOREIGN PATENT DOCUMENTS

CN 105180058 A * 12/2015
DE 102010046021 A1 * 3/2012 ..... F21S 41/147

OTHER PUBLICATIONS

Tomsic, Joan L.. (2000). Dictionary of Materials and Testing (2nd Edition)—photoconductor, (pp. 301). SAE International. Retrieved from https://app.knovel.eom/hotlink/pdf/id:kt00864FH1/dictionary-materials/photoconductor, p. 301 (Year: 2000).*

* cited by examiner

*Primary Examiner* — Omar Rojas Cadima
(74) *Attorney, Agent, or Firm* — CBM Patent Consulting, LLC

(57) ABSTRACT

A transparent light conductor (5) is provided with an optical stop structure (5*a*) and comprises an incident surface (5*b*), an exit surface (5*c*) and upper and lower reflection surfaces (5*d*, 5*e*); a part of incident light is irradiated to a reflection surface (2*a*) of a reflection mirror (2) and is directly reflected to a lens (4); another part of the incident light is irradiated to the incident surface (5*b*) of the transparent light conductor (5) and refracted to the interior of the transparent light conductor (5), and passes through the incident surface (5*b*), and then is refracted to the lens (4) by the exit surface (5*c*).

9 Claims, 5 Drawing Sheets

(51) Int. Cl.
*F21S 41/365* (2018.01)
*F21S 41/255* (2018.01)
*F21W 102/135* (2018.01)

(58) Field of Classification Search
CPC ..... F21S 41/20; F21S 43/20; F21S 43/235; F21S 43/236; F21S 43/245; F21S 43/255; F21S 43/26; F21W 2102/135; F21W 2102/165; F21W 2102/155; F21W 2102/16; F21V 5/02
See application file for complete search history.

TRANSPARENT PHOTOCONDUCTOR HAVING LIGHT SHIELDING FUNCTION, AND APPLICATION THEREOF

BACKGROUND OF THE INVENTION

Technical Field

The invention relates to a projection-type illumination system for vehicle lamps, in particular to a transparent light conductor (guide) having a light shielding function, and a projection-type illumination system for vehicle lamps. According to the transparent light conductor and the projection-type illumination system for vehicle lamps, by replacing a light shielding plate in the prior art with a transparent light conductor having a light path changing function so as to form a brightness-darkness cutoff line and by reusing stray light formed after light is shielded or reflected by the light shielding plate in three ways for illumination, the total light effect of the projection-type illumination system is improved.

Description of Related Art

A common projection-type illumination system for automotive lamps generally includes a light source 1, a reflection mirror 2, a light shielding plate 3, and a lens 4, as shown in FIG. 1, wherein the light shielding plate 3 is provided with an optical stop structure 3*a*; the reflection mirror is ellipsoidal, and the light-emitting center of the light source is located close to the focus of the ellipsoidal reflection mirror; and light emitted by the light source is converged to a position away from the focus of the ellipsoidal reflection mirror after being reflected by the ellipsoidal reflection mirror, the light shielding plate is arranged away from the focus of the ellipsoidal reflection mirror, and finally, a quasi-parallel illumination light shape having a brightness-darkness cutoff line is formed after the light passes through the lens.

As shown in FIG. 2 and FIG. 3, brightness-darkness cutoff lines which are necessary to a passing light shape of a headlamp, and a light shape of a fog lamp are formed through shielding of the optical stop structure 3*a* which has a shape corresponding to the shapes of brightness-darkness cutoff lines required to meet different illumination requirements. FIG. 10 shows a brightness-darkness cutoff line A of the passing light shape. FIG. 11 shows a brightness-darkness cutoff line B, which is a horizontal line, of the fog lamp.

The optical stop structure 3*a* which is arranged on the light shielding plate of 3 of the traditional projection-type illumination system to form the brightness-darkness cutoff line has the following defects:

1. One part of light shielded by the optical stop structure 3*a* cannot be reused, and only a part of light F1 is used for road illumination, so that the wastage of optical energy is caused;

2. One part of the light shielded by the optical stop structure 3*a* is absorbed by the light shielding plate 3, and one part of the light shielded by the optical stop structure 3*a* is reflected by the light shielding plate 3; and due to the fact that the reflected light F2 cannot be controlled, stray light may be formed after the reflected light F2 is reflected by other parts in a lamp to be irradiated onto the road surface;

3. One part of the light reflected by the optical stop structure 3*a* may also be irradiated into other functional regions such as the region of a steering lamp or the region of a position lamp, and consequentially, the light leakage between the functional regions is caused; and 4. Because an irradiation angle of the light source is generally not smaller than 180°, one part of the light cannot be irradiated onto the reflection mirror, and consequentially, the loss of the optical energy is caused.

BRIEF SUMMARY OF THE INVENTION

In order to solve the above problems, the invention provides a projection-type illumination system for vehicle lamps, in particular to a transparent light conductor having a light shielding function, a light path system formed by the transparent light conductor, a projection-type illumination system for vehicle lamps, and an automotive headlamp. According to the invention, the transparent light conductor can form a clear brightness-darkness cutoff line, and makes full use of incident light, namely, the utilization rate of the incident light is increased.

The technical solution of the transparent light conductor having a light shielding function is as follows:

The transparent light conductor having a light shielding function is arranged between a light source 1 and a lens 4, wherein:

An emergent side, close to the lens 4, of the transparent light conductor 5 is provided with an optical stop structure 5*a* used for forming a brightness-darkness cutoff line;

The transparent light conductor 5 is a rectangular block having a section including stepped upper and lower parts;

The transparent light conductor 5 is provided with an incident surface 5*b*, an exit surface 5*c*, an upper reflection surface 5*d*, and a lower reflection surface 5*e*; and One part of incident light is irradiated to a reflection surface 2*a* of a reflection mirror 2 and is directly reflected to the lens 4 so as to form a first part G1 of an illumination light shape G.

According to the invention, the transparent light conductor 5 is the rectangular block having the section including the stepped upper and lower parts, so that the transparent light conductor can form a clear brightness-darkness cutoff line, and makes full use of the incident light, namely, the utilization rate of the incident light is increased.

According to the transparent light conductor having a light shielding function:

A light path formed by the transparent light conductor is as follows:

Another part of the incident light is irradiated to the incident surface 5*b* of the transparent light conductor 5 and refracted to the interior of the transparent light conductor 5, is then refracted to the exit surface 5*c* or reflected to the exit surface 5*c* by the upper incident surface 5*d*, is refracted to the lens 4 by the exit surface 5*c*, and is projected onto a road surface by means of the lens 4 so as to form a second part G2 (FIG. 7) of the illumination light shape, and the light which is not refracted to the lens 4 by the exit surface (5*c*) forms a first part H1 of stray light;

Another part of the incident light is irradiated to the reflection surface 2*a* of the reflection mirror 2, is refracted to the lower reflection surface 5*e* after being reflected to the upper reflection surface 5*d*, and is then refracted to the lens 4 by the lower reflection surface 5*e* so as to form a third part G3 (FIG. 8) of the illumination light shape;

Another part of the incident light is irradiated to the reflection surface (2*a*) of the reflection mirror (2) and is reflected to the lens (4) after being reflected to the upper reflection surface (5*d*) so as to form a fourth part G4 (FIG. 9) of the illumination light shape;

Another part of the incident light is irradiated to the reflection surface (2*a*) of the reflection mirror (2) and is refracted to the interior of the transparent light conductor (5) after being reflected to the upper reflection surface (5*d*) so as to change the light path, and after the light path is changed, the light is totally refracted by the exit surface 5*c*, or is downwards refracted by the lower reflection surface 5*e* to form a second part H2 of the stray light, so that the brightness-darkness cutoff line is formed; and The second part H2, formed by downward refraction of the light by the lower reflection surface 5*e*, of the stray light is not used for road illumination.

According to the transparent light conductor having a light shielding function,

The upper reflection surface 5*d* and the lower reflection surface 5*e* of the transparent light conductor 5 are planes.

According to the transparent light conductor having a light shielding function,

The upper reflection surface (5*d*) of the transparent light conductor (5) includes stepped upper and lower parts, and the upper part is in oblique transition with the lower part.

According to the transparent light conductor having a light shielding function,

A height difference between the stepped upper and lower parts of the transparent light conductor 5 is 1-3 mm.

Preferably, the height difference between the stepped upper and lower parts of the transparent light conductor 5 is 1.2-1.5 mm.

According to the transparent light conductor having a light shielding function,

The incident surface 5*b* and the exit surface 5*c* of the transparent light conductor 5 are in a convex arc shape.

According to the transparent light conductor having a light shielding function,

A portion, corresponding to the upper part over the lower part of the transparent light conductor 5, of the incident surface is oblique.

According to the transparent light conductor having a light shielding function,

The brightness-darkness cutoff line is formed due to a light path change caused by light reflection to the interior of the transparent light conductor (5) by the reflection surface (5*d*), and one part of the light refracted to the exit surface 5*c* is totally reflected to be finally irradiated below the transparent light conductor.

According to the transparent light conductor having a light shielding function,

The optical stop structure 5*a* is arranged on the emergent side of the transparent light conductor.

According to the transparent light conductor having a light shielding function,

The light source 1 is a semiconductor light-emitting chip.

According to the transparent light conductor having a light shielding function,

The transparent light conductor 5 is made from glass through firing and rolling formation or is made from transparent plastic through injection molding.

The invention further provides a projection-type illumination system for vehicle lamps, wherein:

The projection-type illumination system adopts the transparent light conductor having a light shielding function.

The invention further provides a headlamp, which adopts the projection-type illumination system for vehicle lamps.

The invention has the following beneficial effects: by replacing a light shielding plate in the prior art with a transparent light conductor having a light path changing function so as to form the brightness-darkness cutoff line and reusing stray light formed after light is shielded or reflected by the light shielding plate in three ways for illumination, the total light effect of the projection-type illumination system is improved. Approach 1: One part of light which is not irradiated to the reflection surface is reflected to the incident surface of the transparent light conductor 5, and is refracted to the lens 4 by the exit surface 5*c* after passing through the transparent light conductor, so as to be used for road illumination. Approach 2: One part of the light is reflected to the upper reflection surface 5*d* of the transparent light conductor 5 by the reflection surface 2*a* of the reflection mirror 2, and is reflected to the lens 4 by the reflection surface 5*d*, so as to be used for road illumination. Approach 3: One part of the light is reflected to the upper reflection surface 5*d* of the transparent light conductor 5 by the reflection surface 2*a* of the reflection mirror 2, is refracted to the interior of the transparent light conductor 5 by the reflection surface 5*d*, and is refracted to the lens 4 by the lower reflection surface 5*e*, so as to be used for the road illumination. By means of the above three approaches, uncontrolled stray light is reduced while the light effect is improved, that is to say, the utilization rate of the incident light is increased while the clear brightness-darkness cutoff line is formed by the transparent light conductor.

Reference Signs: 1, light source; 2, reflection mirror; 2*a*, reflection surface of reflection mirror 2; 3, light shielding plate; 3*a*, optical stop structure; 4, lens; 5, transparent light conductor; 5*a*, optical stop structure; 5*b*, incident surface; 5*c*, exit surface; 5*d*, upper reflection surface; 5*e*, lower reflection surface. A is the brightness-darkness cutoff line of the passing light shape, and B is the brightness-darkness cutoff line of the fog lamp; F1 is illumination light of an existing projection-type illumination system, and F2 is stray light; G is illumination light of the illumination system of the invention and includes G1, G2, G3, and G4 according to their origins wherein G1 is a first part, formed after a part of incident light is directly reflected to the lens 4 by the reflection surface 2*a*, of an illumination light shape G, G2 is a second part, formed after another part of the incident light is refracted to the interior of the light conductor 5 by the incident surface 5*b*, is then refracted to the exit surface 5*c* or reflected to the exit surface 5*c* by the upper reflection surface 5*d* and is then refracted to the lens 4, of the illumination light shape, G3 is a third part, formed after another part of the incident light passes through the reflection surface 2*a*, is refracted to the lower reflection surface 5*e* by the upper reflection surface 5*d*, and is then refracted to the lens, of the illumination light shape, and G4 is a fourth part, formed after the incident light passes through the reflection surface (2*a*) and is then reflected to the lens (4) by the upper reflection surface (5*d*), of the illumination light shape; and H is the stray light of the illumination system of the invention and includes a first part H1 and a second part H2 according to their origins.

DETAILED DESCRIPTION OF THE INVENTION

Figure 1:
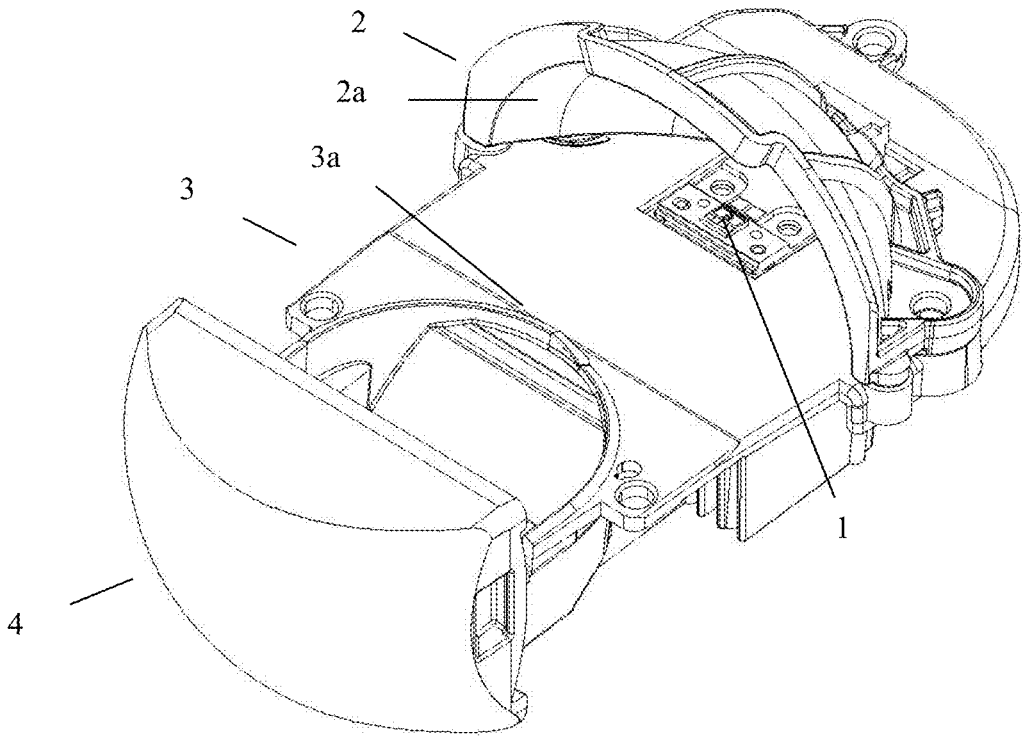
FIG. 1 is a schematic diagram of a common projection-type illumination system for automotive lamps.
Figure 2:
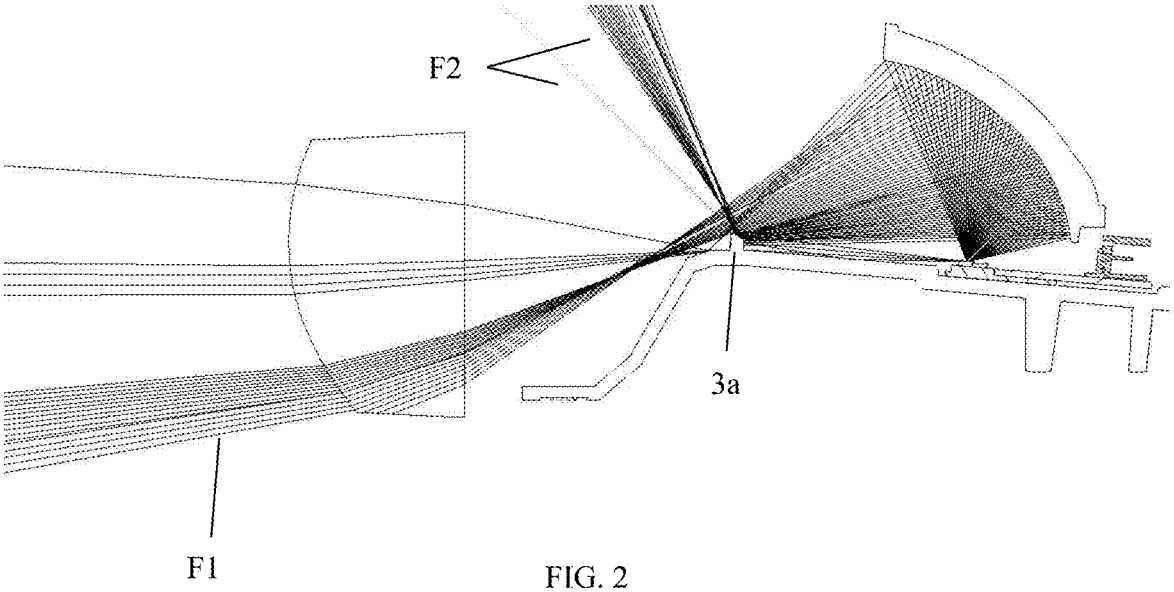
FIG. 2 and FIG. 3 are respectively schematic diagrams of brightness-darkness cutoff lines which are necessary to a passing light shape of a headlamp, and a light shape of a fog lamp and are formed through shielding of an optical stop structure 3*a;*
Figure 3:
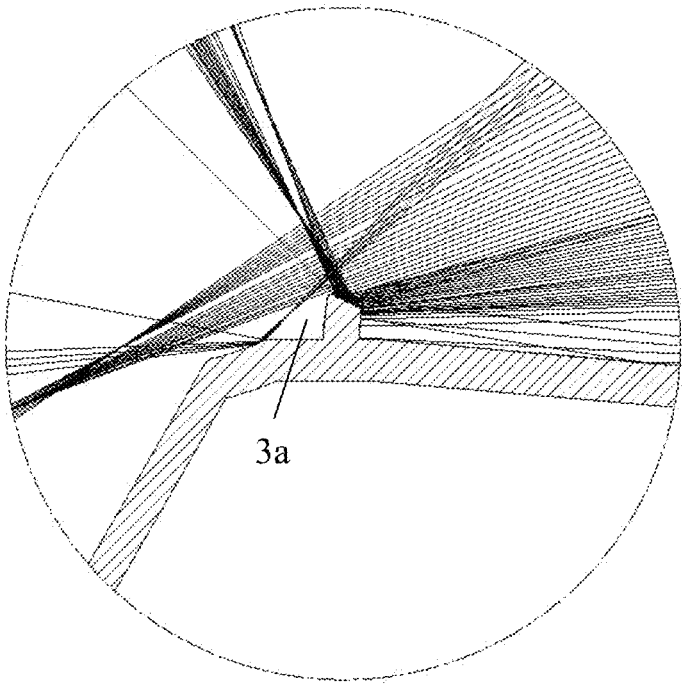
Figure 4:
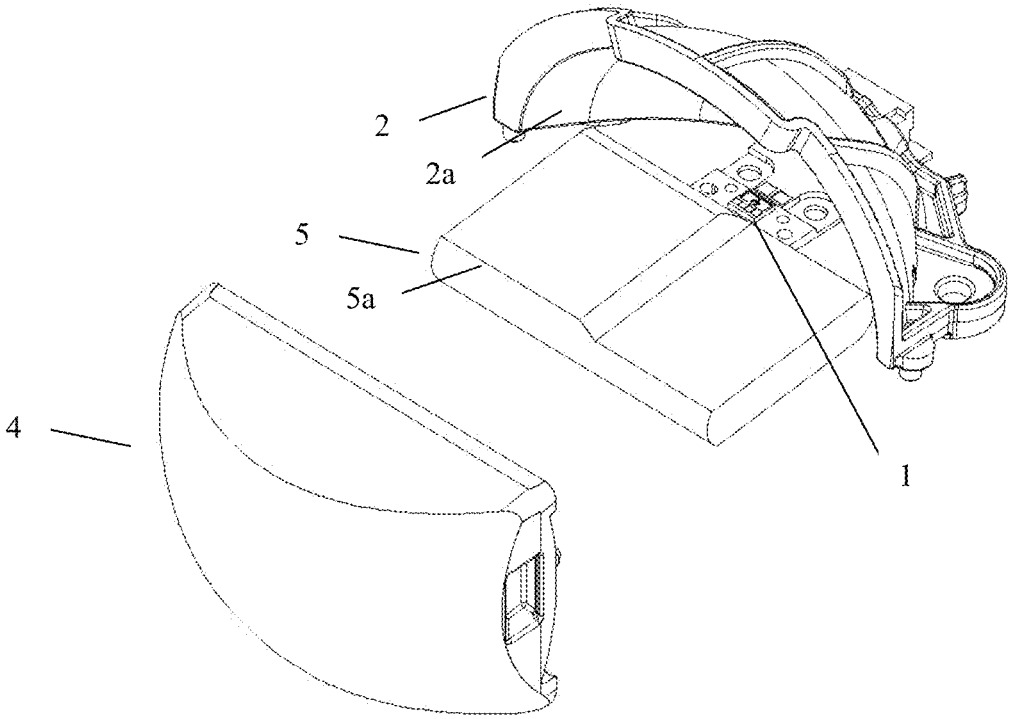
FIG. 4 is an assembly diagram of the projection-type illumination system for vehicle lamps of the invention.
Figure 5:
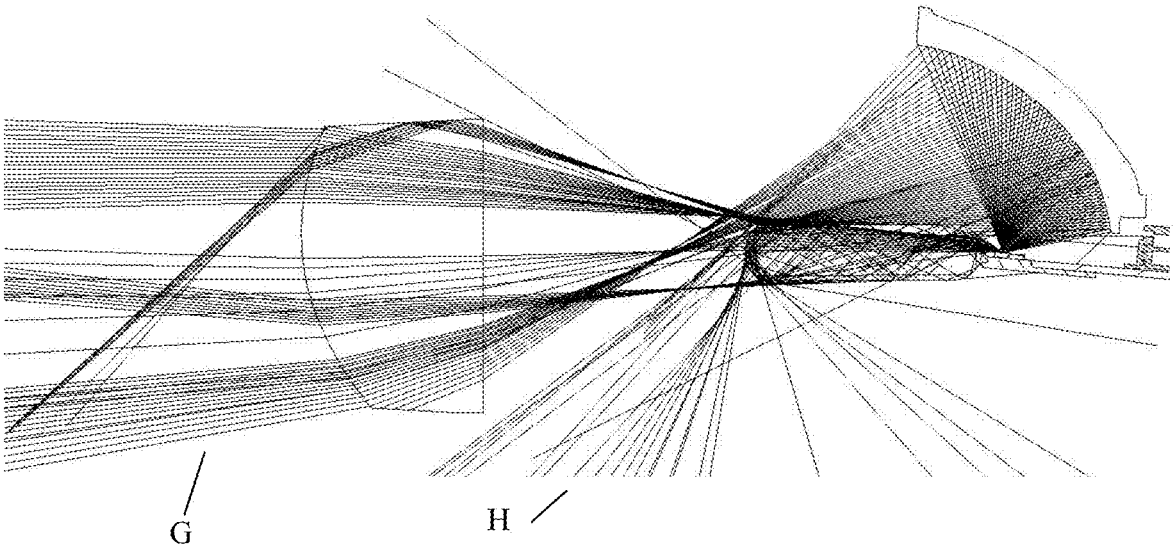
FIG. 5 is a light refraction and projection diagram of a light conductor and the illumination system of the invention.
Figure 6:
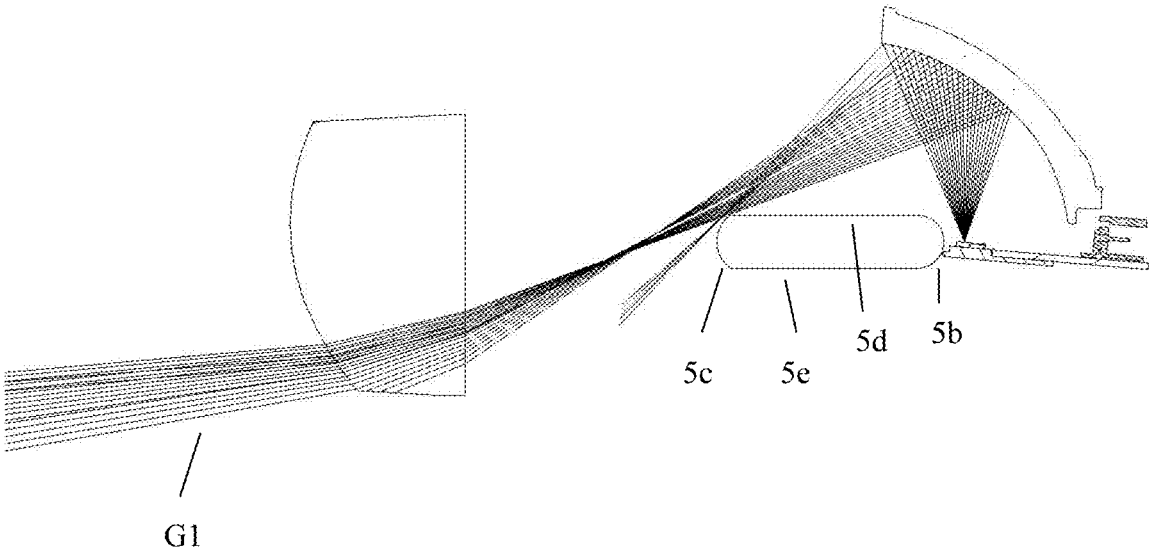
FIG. 6 is a light refraction and projection diagram of the light conductor and the illumination system of the invention.

As shown in FIG. 4 and FIG. 5, an illumination system of the invention includes a light source 1, a reflection mirror 2, a transparent light conductor 5 and a lens 4, wherein the transparent light conductor 5 is provided with an optical stop structure 5*a* used for forming a brightness-darkness cutoff line and is further provided with an incident surface 5*b*, an exit surface 5*c*, an upper reflection surface 5*d*, and a lower reflection surface 5*e*; and the light source 1 is preferably a semiconductor light-emitting chip. One part of light emitted by the light source 1 is irradiated to a reflection surface 2*a* of the reflection mirror 2 and is partially reflected by the reflection surface 2 to the lens 4, and the other part of the light is reflected to the upper reflection surface 5*d*, as shown in FIG. 5; and one part of the light is irradiated to the incident surface 5*b* of the transparent light conductor 5 and is refracted to the interior of the transparent light conductor 5.

Figure 7:
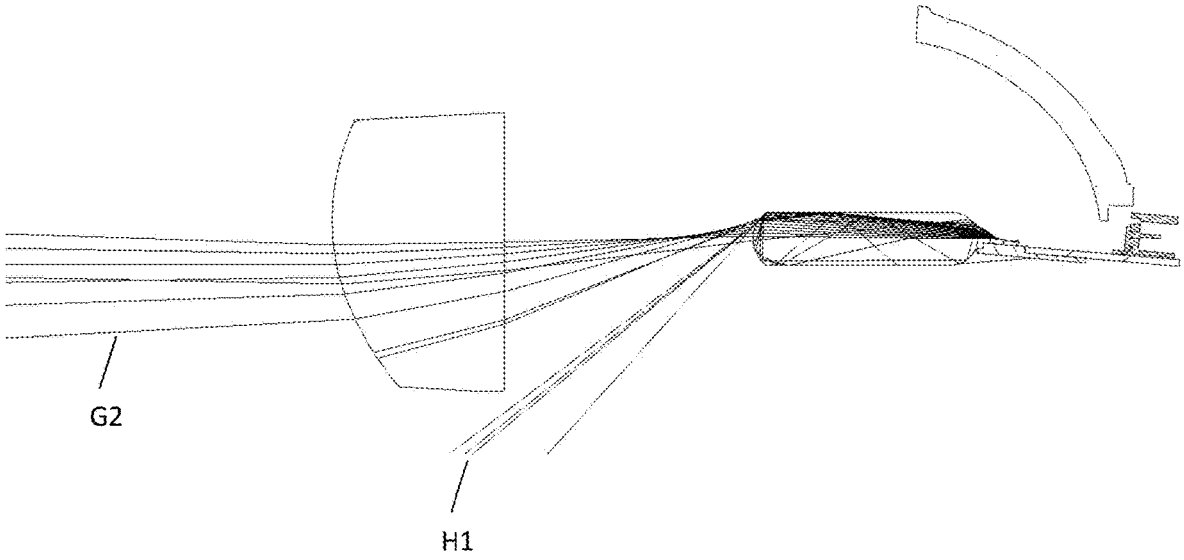
FIG. 7 is a light refraction and projection diagram of the light conductor and the illumination system of the invention.

One part of the light refracted to the interior of the light conductor 5 is refracted to the exit surface 5*c* by the incident surface 5*b* or reflected to the exit surface 5*c* by the upper reflection surface 5*d*, is then refracted to the lens 4 by the exit surface 5*c*, and is projected onto a road surface by means of the lens 4 so as to form one part G2 (FIG. 7) of the illumination light shape.

Figure 8:
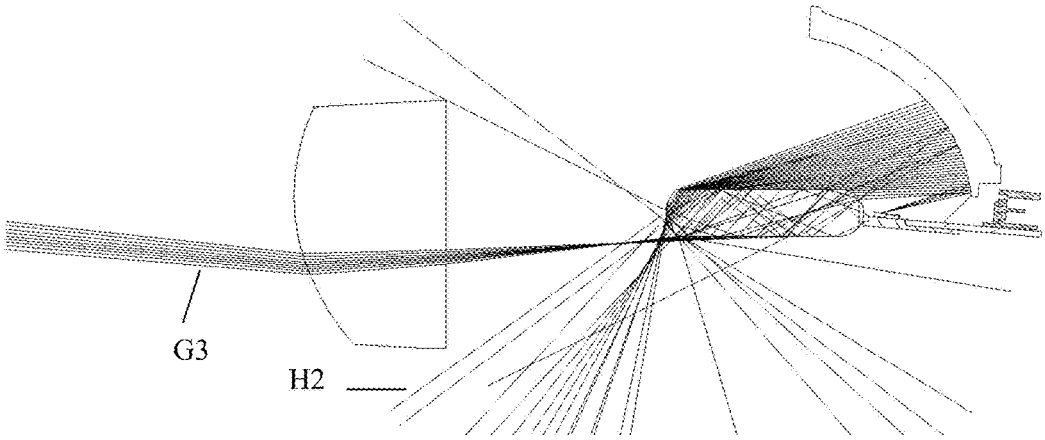
FIG. 8 is a light refraction and projection diagram of the light conductor and the illumination system of the invention.

Another part of the incident light is irradiated to the reflection surface 2*a* of the reflection mirror 2, is refracted to the lower reflection surface 5*e* after being reflected to the upper reflection surface 5*d*, and is then refracted to the lens 4 by the lower reflection surface 5*e* so as to form another part G3 (FIG. 8) of the illumination light shape; and as shown in FIG. 8, the incident light is projected to the road surface by the lens 4 so as to form one part of the illumination light shape.

Figure 9:
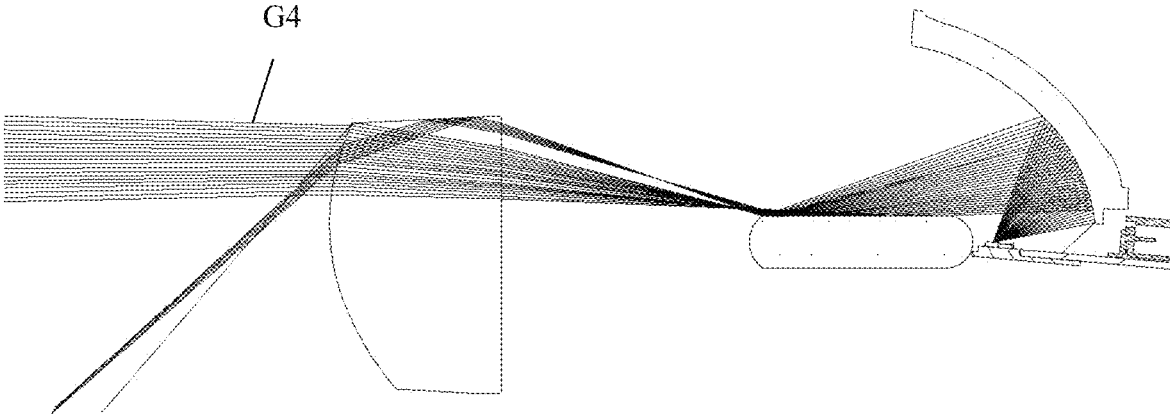
FIG. 9 is a light refraction and projection diagram of the light conductor and the illumination system of the invention.
Figure 10:
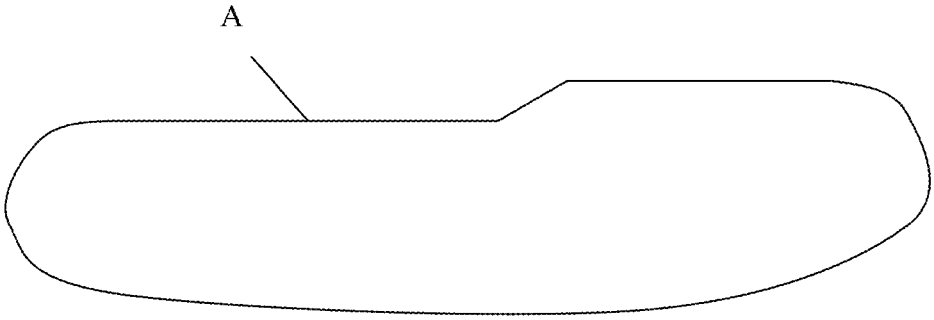
FIG. 10 is a schematic diagram of brightness-darkness cutoff line A of the passing light shape.
Figure 11:
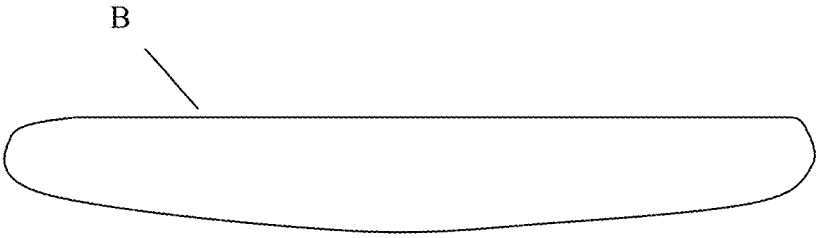
FIG. 11 is a schematic diagram of the brightness-darkness cutoff line, namely a horizontal line, of the fog lamp.

Another part of the incident light is irradiated to the reflection surface (2*a*) of the reflection mirror (2) and is reflected to the lens (4) after being reflected to the upper reflection surface (5*d*) so as to form another part G4 (FIG. 9) of the illumination light shape.

A light path change caused by light reflection to the interior of the transparent light conductor 5 by the reflection surface 5*d* is the key to forming the brightness-darkness cutoff line, wherein one part of the light refracted to the exit surface 5*c* is totally reflected due to the fact that an incident angle is larger than a total reflection angle; as shown in FIG. 8, the light is finally irradiated below the transparent light conductor to form uncontrollable stray light H2 and cannot reach the lens 4 to be used for road illumination, thereby being incontrollable light.

One part of the light refracted to the lower reflection surface 5*e* is refracted to the lens 4 by the lower reflection surface 5*e* so as to form one part of the illumination light shape, and a light path change caused by two times of light refraction by the upper reflection surface 5*d* and the lower reflection surface 5*e* is also a key to forming the brightness-darkness cutoff line.

According to the transparent light conductor and the projection-type illumination system for vehicle lamps, by replacing a light shielding plate in the prior art with the transparent light conductor having a light shielding function so as to form the brightness-darkness cutoff line and reusing stray light after light is shielded or reflected by the light shielding plate in three ways for illumination the total light effect of the projection-type illumination system is improved.

What is claimed is:

1. A transparent light conductor having a light shielding function, being arranged between a light source (1) and a lens (4), wherein:

an emergent side, close to the lens (4), of the transparent light conductor (5) is provided with an optical stop structure (5*a*) used for forming a brightness-darkness cutoff line;

the transparent light conductor (5) is a rectangular block having a section including stepped upper and lower parts;

the transparent light conductor (5) is provided with an incident surface (5*b*), an exit surface (5*c*), an upper reflection surface (5*d*), and a lower reflection surface (5*e*);

one part of incident light is irradiated to a reflection surface (2*a*) of a reflection mirror (2) and is directly reflected to the lens (4) so as to form a first part (G1) of an illumination light shape;

another part of the incident light comprises a first portion, a second portion, a third portion and a fourth portion, wherein light paths formed by the transparent light conductor are as follows:

the first portion of the another part of the incident light is irradiated to the incident surface (5*b*) of the transparent light conductor (5) and refracted to an interior of the transparent light conductor (5), is then refracted to the exit surface (5*c*) or reflected to the exit surface (5*c*) by the upper incident surface (5*d*), is refracted to the lens (4) by the exit surface (5*c*), and is projected onto a road surface by means of the lens (4) so as to form a second part (G2) of the illumination light shape, and the light which is not refracted to the lens (4) by the exit surface (5*c*) forms a first part (H1) of stray light;

the second portion of the another part of the incident light is irradiated to the reflection surface (2*a*) of the reflection mirror (2), is refracted to the lower reflection surface (5*e*) after being reflected to the upper reflection surface (5*d*), and is then refracted to the lens (4) by the lower reflection surface (5*e*) so as to form a third part (G3) of the illumination light shape;

the third portion of the another part of the incident light is irradiated to the reflection surface (2*a*) of the reflection mirror (2) and is reflected to the lens (4) after being reflected to the upper reflection surface (5*d*) so as to form a fourth part (G4) of the illumination light shape; and the fourth portion of the another part of the incident light is irradiated to the reflection surface (2*a*) of the reflection mirror (2) and is refracted to the interior of the transparent light conductor (5) after being reflected to the upper reflection surface (5*d*) so as to change the light path, and after the light path is changed, the light is totally refracted by the exit surface (5*c*), or is downwards refracted by the lower reflection surface (5*e*) to form a second part (H2) of the stray light, so that the brightness-darkness cutoff line is formed.

2. The transparent light conductor having a light shielding function according to claim 1, wherein:

the upper reflection surface (5*d*) and the lower reflection surface (5*e*) of the transparent light conductor (5) are planes.

3. The transparent light conductor having a light shielding function according to claim 2, wherein:

the upper reflection surface (5*d*) of the transparent light conductor (5) includes the stepped upper and lower parts, and the upper part is in oblique transition with the lower part.

4. The transparent light conductor having a light shielding function according to claim 3, wherein:

a height difference between the stepped upper and lower parts of the transparent light conductor (5) is 1-3 mm.

5. The transparent light conductor having a light shielding function according to claim 1, wherein:

the incident surface (5*b*) and the exit surface (5*c*) of the transparent light conductor (5) are in a convex arc shape.

6. The transparent light conductor having a light shielding function according to claim 1, wherein:

a portion, corresponding to the upper part over the lower part of the transparent light conductor (5), of the incident surface is oblique.

7. The transparent light conductor having a light shielding function according to claim 1, wherein:

the brightness-darkness cutoff line is formed due to a light path change caused by light reflection to an interior of the transparent light conductor (5) by the reflection surface (5*d*), and one part of the light refracted to the exit surface (5*c*) is totally reflected to be finally irradiated below the transparent light conductor.

8. A projection-type illumination system for vehicle lamps, comprising a light source (1), a reflection mirror (2) arranged beside the light source (1), as well as a lens (4) arranged on an emergent side, wherein the projection-type illumination system adopts the transparent light conductor having a light shielding function according to claim 1.

9. A headlamp, adopting the projection-type illumination system for vehicle lamps according to claim 7.

* * * * *